US009056229B2

(12) United States Patent
Hungerbach et al.

(10) Patent No.: US 9,056,229 B2
(45) Date of Patent: Jun. 16, 2015

(54) PIECE OF SPORTS EQUIPMENT

(75) Inventors: Wolfgang Hungerbach, Muellheim (DE); Reiner Nowak, Binzen (DE)

(73) Assignee: GLATT SYSTEMTECHNIK GMBH, Dresden (DE)

( * ) Notice: Subject to any disclaimer, the term of this patent is extended or adjusted under 35 U.S.C. 154(b) by 167 days.

(21) Appl. No.: 13/561,280

(22) Filed: Jul. 30, 2012

(65) Prior Publication Data

US 2013/0109512 A1 May 2, 2013

Related U.S. Application Data

(60) Provisional application No. 61/628,476, filed on Nov. 1, 2011.

(51) Int. Cl.

| | |
|---|---|
| ***A63B 59/00*** | (2006.01) |
| ***A63C 5/00*** | (2006.01) |
| ***A63C 1/00*** | (2006.01) |
| ***A63B 59/06*** | (2006.01) |

(52) U.S. Cl.

CPC ..... *A63B 59/0092* (2013.01); *A63B 59/00* (2013.01); *A63B 59/06* (2013.01); *A63B 59/0029* (2013.01); *A63B 2059/0003* (2013.01)

(58) Field of Classification Search

CPC .... A63B 59/06; A63B 59/0092; A63B 53/00; A63B 53/145; A63B 59/0014; A63B 2053/0491; A63B 2053/0495; A63B 53/14; A63B 59/0096; A63B 59/14; A63B 53/10; A63B 53/12

USPC ..... 473/457, 519, 520, 564–568, 560, 561, 473/549, 318; 280/14.21–14.24, 819, 280/601–603, 609, 87.01–87.042

See application file for complete search history.

(56) References Cited

U.S. PATENT DOCUMENTS

| | | | | |
|---|---|---|---|---|
| 3,801,098 | A * | 4/1974 | Gildemeister | 473/520 |
| 5,180,163 | A * | 1/1993 | Lanctot et al. | 473/520 |
| 5,183,264 | A * | 2/1993 | Lanctot | 473/520 |
| 5,197,732 | A * | 3/1993 | Lanctot | 473/523 |
| 5,203,561 | A * | 4/1993 | Lanctot | 473/282 |
| 5,777,947 | A * | 7/1998 | Ahuja | 367/1 |
| 6,117,028 | A | 9/2000 | You | |
| 8,092,882 | B2 * | 1/2012 | Sommer | 428/36.91 |
| 2005/0107182 | A1 * | 5/2005 | Meyer et al. | 473/318 |
| 2009/0209371 | A1 * | 8/2009 | Tremulis et al. | 473/409 |

FOREIGN PATENT DOCUMENTS

| | | | |
|---|---|---|---|
| DE | 29822451 | U1 | 4/1999 |
| DE | 102004003507 | B4 | 8/2005 |

* cited by examiner

*Primary Examiner* — Mark Graham

(74) *Attorney, Agent, or Firm* — Jacobson Holman, PLLC.

(57) ABSTRACT

The invention relates to a piece of sports equipment which is subject to a shock-like load. In a piece of sports equipment in accordance with the invention, an elongated support element is present which is at least regionally inwardly hollow. It can, for example, be an at least almost complete baseball bat or also only a part region at which a handle of a piece of sports equipment is present. At least one hollow space in which metallic and/or ceramic hollow bodies are present is present in the support element. In the piece of sports equipment, the support element can form the outer skin or at least a part thereof.

13 Claims, 4 Drawing Sheets

PIECE OF SPORTS EQUIPMENT

Figure 1:
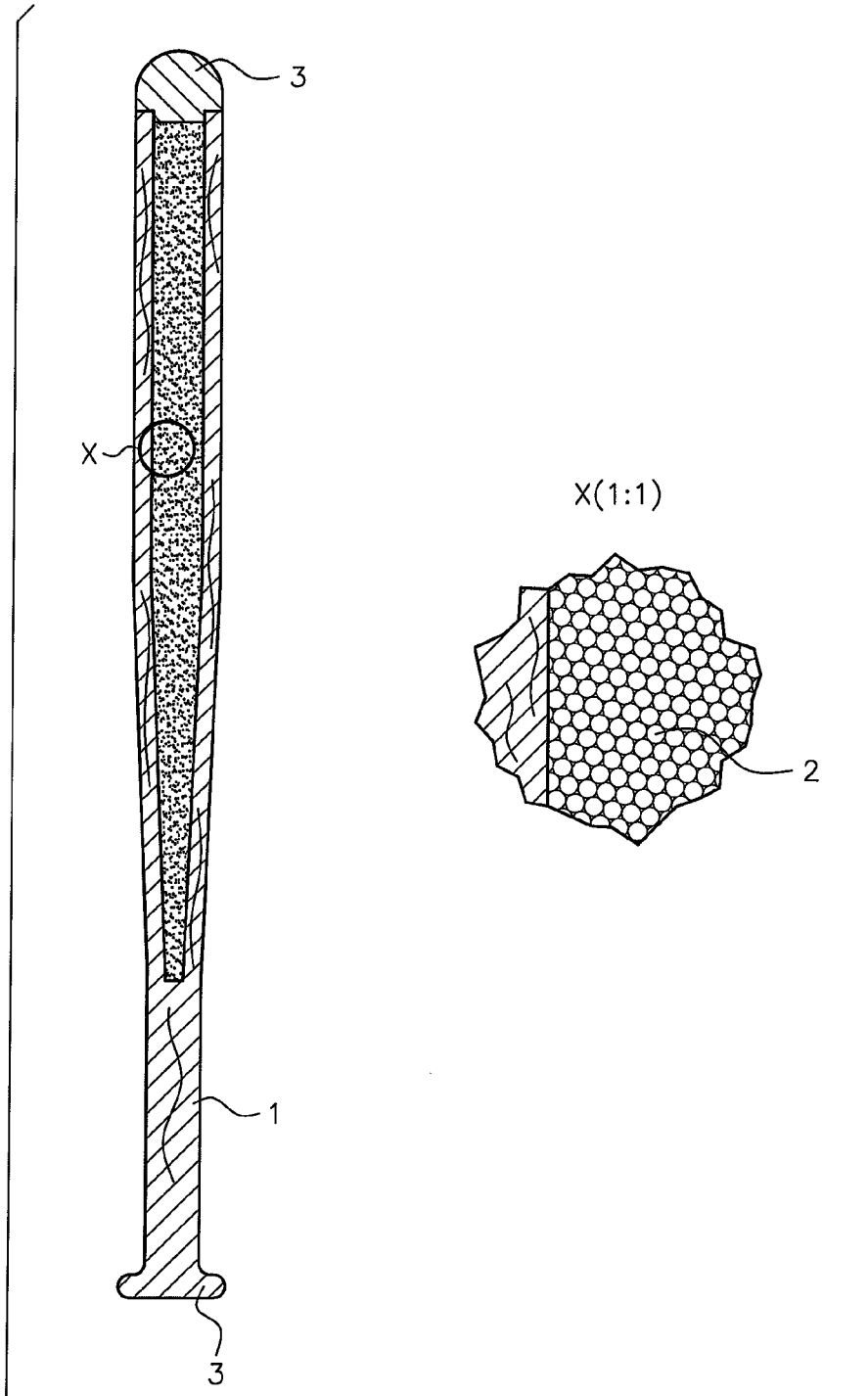

This application claims the benefit of U.S. provisional application No. 61/628,476, filed Nov. 1, 2011, hereby incorporated by reference.

The invention relates to a piece of sports equipment which is subject to a shock-like load.

In particular with ball sports, balls are hit using a bat and are accelerated in so doing. In this respect, reaction forces act on the bat as a batting implement and are transmitted to a grip or gripping region for hands of an athlete. In this respect, the shock does not only act on the hand on impact, but other vibrations transmitted in the bat also act on the hand or on both hands of an athlete, which is unpleasant and can be painful. The ability to convey a ball precisely in the desired direction with the desired acceleration can thereby also be impaired.

Such problems also occur in a similar manner with other pieces of sports equipment.

To counter these disadvantages, attempts have been made to use vibration-damping soft materials or movable elements which can exert vibrating movements. The materials used for this purpose, however, only achieve an unsatisfactory vibration-damping effect.

On the use of vibrating masses such as is known, for example, from DE 298 22 451 U1, it is disadvantageous that a mass has to be present at a point on a bat or batting implement which has to be set into vibration there and the vibrations simultaneously have thereby to be damped. A sufficiently large inherent mass of the vibrating element is sufficient for this purpose, but it is arranged at a position and accordingly also influences the functionality of the bat or batting implement. This is in particular the case when a direct arrangement at the center of mass is not possible.

In addition, the mechanical properties, and in particular the strength, are also disadvantageously influenced by the installation of such vibrating elements within a bat or batting implement.

In this respect, a fracture can occur which can in turn result in injuries to athletes or spectators.

It is therefore the object of the invention to achieve pieces of sports equipment having improved vibration damping and blow damping while maintaining the actual functional properties of a piece of sports equipment.

In accordance with the invention, this object is achieved by a batting implement having the features of claim 1. Advantageous embodiments and further developments of the invention can be realized using features designated in the subordinate claims.

In a piece of sports equipment in accordance with the invention, an elongated support element is present which is at least regionally inwardly hollow. It can, for example, be an at least almost complete baseball bat or also only a part region at which a handle of a piece of sports equipment is present. At least one hollow space in which metallic and/or ceramic hollow bodies are present is present in the support element. In the piece of sports equipment, the support element can form the outer skin or at least a part thereof.

Freely movable solid particles are particularly advantageously included in the hollow bodies. The vibration-damping effect can be considerably improved by the particles or also by further hollow bodies and the vibration decay time can also be shortened in this respect.

The hollow bodies can in this respect be hollow spheres.

On the manufacture of the hollow bodies, in which loose, freely movable particles are included, the solid particles included in a layer formed directly on the surface of the polymer core should, where possible, decompose subsequent to the expulsion of the organic components (e.g. pyrolysis). The loose, freely movable particles are thereby released before the sintering which results in the formation of the shell of hollow bodies. Accordingly, a selection of a material suitable for this purpose for the powdery particles included in the layer formed directly on the surface of the polymer core should take the respective sintering temperatures into account. A material can thus be selected for the powdery particles in this layer which has a much higher sintering temperature than the powdery particles which result in the formation of the shell of hollow bodies by sintering. Materials of powdery particles should be used for this purpose whose sintering temperature differs by at least 100 K, preferably by at least 200 K.

The release of the particles from the layer formed directly on the surface of the polymer core on a heat treatment can also be assisted in that a high portion of place maintaining binder components, preferably organic binder components, can form this layer together with powdery particles.

It should also be taken into account in this phase of the manufacture of hollow bodies that a shrinking/contraction usually occurs on sintering which results in a reduction in the volume and accordingly also in the size/the diameter of the shell of the hollow bodies. Accordingly, the inner layer which had been applied directly to the polymer core should have decomposed in advance where possible and should not have formed any inner shell of its own which is in direct contact with the outer layer forming the outer shell by sintering during the actual sintering process so that no inherent strains are formed at such shells and also crack formation at shells of hollow bodies can be avoided.

The freely movable solid particles included in hollow bodies should be formed from materials inert for the material ultimately forming the shell of the hollow bodies and should also not have any other affinities to this material.

Suitable materials are, for example, carbides, nitrides, oxides, silicides or aluminides which can also be included as mixtures in hollow bodies. They should, however, withstand the mentioned increased sintering and melting temperatures.

The particles can preferably be formed from suitable oxides such as $Al_2O_3$, MgO, $ZrO_2$ or $Y_2O_3$, with the respective sintering temperatures here being above many suitable metals or metal alloys which are suitable for the forming of shells of hollow bodies in a powder-metallurgic manner.

Such particles, which can be included loosely and freely movably in hollow bodies, can also be suitable silicates such as kaolin, for example.

The powdery starting materials used for the layer directly formed on the polymer core can be used with particle sizes in the range from 5 nm up to 500 μm. Particles with sizes above 100 μm can preferably be embedded in cores which have been manufactured by extrusion, powder granulation or pelletization, with further explanations being given on options for this in the following.

With pieces of sports equipment in accordance with the invention, however, hollow bodies which are completely hollow can also be used in conjunction with the hollow bodies including fixed particles in accordance with the invention so that a reduction of mass can be achieved within certain limits.

The physical density of hollow bodies can be held at ≤1 $g/cm^3$.

There are several possibilities to manufacture such hollow bodies including solid particles.

A procedure can, for example, be followed such that a multilayer coating is applied to a core of an organic material, preferably a polymer material, for example polystyrene, with then the ultimate outer shell of the hollow bodies subsequently being able to be formed at least by means of the topmost layer.

Powdery particles are then included in individual layers of such a coating. In this respect, the powdery particles which should form the hollow bodies are formed from a sinterable material (metal, ceramic material). The powdery particles which are included in the layer formed directly on the core are, however, on the contrary, formed from a material which can be sintered less suitably or at much higher temperatures than the actual shell material.

The correspondingly coated cores are then subsequently subjected to a thermal treatment in a form known per se, with the organic components being expelled in a first step, optionally after a previous drying (e.g. pyrolysis). The temperature is subsequently increased and a sintering takes place for forming the closed shells which then results in an inclusion of the solid particles not sintered to one another within hollow spaces surrounded by shells.

Metal powders such as iron with copper, with the copper being able to be infiltrated into an iron shell, can preferably be the powdery particles which are contained on a layer formed directly on the core and which form the shell of the hollow bodies on the sintering. The particle size of these metal powders should be kept at least at 30 μm.

Subsequent to the heat treatment to be carried out for forming the coating formed from at least two layers, as already addressed, organic components are first then expelled again and subsequent to this the formation of a further hollow body takes place by sintering the powdery articles which were included in the layer directly formed on the polymer core. Supported by the smaller particle size of the particles contained in this layer, the volume and accordingly also the outer dimensions of the further hollow body are reduced considerably more than in the subsequent sintering of the powdery particles which are included in the outer layer and which form the shell of the hollow bodies. After the sintering, the outer dimensions of the respective further hollow body within the shell of hollow bodies are accordingly smaller than their inner volume so that a free movability of the respective further hollow bodies within the hollow bodies is possible.

By the selection of suitable powders and by the setting of a targeted consistency for the layers which form the coating on the polymer core, influence can be taken on the shell thickness and the already initially mentioned parameters as well as on the degree of filling with solid, loose particles within the hollow spaces. The shell thickness of the hollow bodies and their outer and inner dimensions can naturally also be correspondingly influenced so that the total mass of the hollow bodies and the mass ratio of particles:shell can also be set.

The mass of particles included in hollow bodies or further hollow bodies should advantageously be the mass of the respective shell of a hollow body.

The hollow bodies to be used in accordance with the invention can, however, also be manufactured such that the cores which should subsequently be coated are manufactured from a mixture of solid particles and an organic substance or substance mixture. Organic binders/plastics known per se and suitable can be used as organic substances or substance mixtures. The manufacture of such cores can take place with the aid of an extruder, for example. In this respect, the extrudate can be pressed through a correspondingly designed die and adopt a desired geometrical shape. The strand exiting the die can then be cut to a corresponding length in individual parts.

Cores which include particles can, however, also be manufactured by powder granulation and other pelletization methods.

In certain cases, the cores manufactured in this manner and optionally cut to a certain length can also be rounded in a manner known per so that they can adopt an almost completely spherical design.

The cores manufactured in this manner are then covered by at least one layer in which a sinterable powdery material is included.

A temperature treatment which is carried out as already described can subsequently be carried out. In this respect, the organic components are expelled from the core and optionally also from the top layer by a first process step (e.g. pyrolysis) and the sintering is then in turn carried out subsequently to form the shells of the hollow bodies.

The manufacture is also described in DE 10 2004 003 507 B4 and use is made in full of its disclosure content.

The hollow bodies can be connected to one another with material continuity and/or be embedded in a matrix of a substance. The connection with material continuity can be achieved by adhesive bonding, soldering or also by a sintering together of the hollow bodies. Hollow bodies can, however, also be embedded in a polymer matrix, for example a resin, and surrounded by the polymer. The total mass of the respective batting implement can also be influenced by an adhesive, a solder or a polymer if an increase in mass is necessary due to the small mass of the hollow bodies. The mass distribution within the volume can also be influenced in that the proportion of hollow bodies per volume unit is varied in different regions.

The hollow bodies should advantageously be connected using an additional substance in the interior of the support element to said support element with material continuity to improve the vibration transmission to the hollow bodies. An additional material can in this respect be a previously already mentioned adhesive, a polymer or also a solder.

To improve safety, a hollow space of a support element can be anchored using at least one anchor element to a proximal or distal end and in so doing the anchor element can be fastened to the support element by means of a pulling cable or a band conducted through the hollow space to a fastening point or to a second anchor element. It can thereby be prevented, even on a complete break of the batting implement, that one or more parts are hurled off and that thus other persons or the athlete himself can be injured.

It is particularly advantageous for this purpose if openings are closed by a respective anchor element at both a distal end and at the proximal end of the support element and a hollow space is led through the total support element from a distal opening to a proximal opening. In this case, a pulling cable or a band can likewise be conducted from the distal end to the proximal end of a support element and can therefore hold broken-off parts of the batting implement. A core element can also be present in the hollow space beside the hollow bodies. This core element can be surrounded by the hollow bodies so that they so-to-say form a skin for a core element. A core element can increase the mechanical strength of the piece of sports equipment. It can, however, also be designed so that a specific mass or also a mass distribution is achieved within the piece of sports equipment. In addition, a core element can increase safety when it is fixed to at least one anchor element as an already mentioned band or pulling cable. Core elements can be manufactured from metal, ceramics, polymer or as a fiber composite.

A pulling cable or such a band can be provided with a tensioning mechanism so that they exert a pulling force by which one or also two anchor elements can be reliably held and fixed at the support element. A core element can, for example, be provided with a thread with which it can be screwed into a thread of an anchor element and thus a pulling force can be applied.

The tensile strength and the bending strength as well as the safety can moreover be increased in that a reinforcement component is additionally included in the interior of the support element, in particular in the form of a fiber mat, individual fibers or fiber bars, together with the hollow bodies. The reinforcement component can in this respect advantageously be embedded together with the hollow bodies in a polymer, preferably in a resin. Safety can thereby also be increased in the event of a break since no parts of the piece of sports equipment can break off or even fly off.

There is moreover the possibility of also including ceramic Fillite or foamed glass spheres in a support element beside hollow bodies. A reduction of costs can thereby also be achieved in addition to an increase in strength.

The support element can be formed from wood, metal, in particular aluminum or an aluminum alloy, or a composite material. In this respect, a composite material can, for example, be a polymer reinforced with fiberglass or carbon fiber.

The hollow bodies inserted in the support element can advantageously have different outer diameters, wall thicknesses/shell thicknesses and/or portions of solid particles included therein. A matching to different vibration frequencies which should be damped is thereby possible. With different outer diameters a filling of the support element is possible in which all hollow bodies have touching contacts to hollow bodies arranged next to one another or to the inner wall of the support element.

There is moreover the possibility of forming at least one grip region of the piece of sporting equipment from mutually sintered hollow bodies. The surface can thereby be designed with more grip and the vibration damping can also be improved in this region. The grip region can in this respect be formed on the surface of the support element using applied hollow bodies or hollow bodies fastened there. There is, however, also the possibility of providing an opening at the support element in a grip region which is then filled with hollow bodies.

On the manufacture of a piece of sports equipment in accordance with the invention, the filling of a support element hollow on the inside with hollow bodies can be assisted by applying a vacuum. In this respect, the support element can also be set into vibration, alone or additionally, which is possible using a vibrating table, for example.

As already addressed, hollow bodies can be connected to one another with material continuity, and in so doing be embedded in a matrix, using a polymer which can be an impact-resistant polyamide or a resin. A two-component resin having a hardening component can be used as the resin. The ratio of the two components can in this respect be set such that the viscosity can be utilized, for example, for a favorable filling of a hollow space of a support element with a smaller portion of hardening component and thereby for an improved flow behavior. A lower heating thereby also occurs in the exothermal cross-linking. A doughy consistency can be obtained with a higher portion of hardening component and the hardening time is shortened.

The manufacture of a piece of sports equipment in accordance with the invention can also take place such that a base body comprising hollow bodies which are sintered to one another or are connected to one another with material continuity by a polymer or solder is provided with an envelope which can satisfy the function of the support element. In the simplest case, the envelope can in this respect be a metal jacket, which can be the case, for example, for a golf club in the handle region. An envelope can, however, also be formed with a fiber composite of fiberglass or carbon fibers with a polymer which is wound around the base body in the non-hardened state and then hardened.

The selection of the hollow bodies and their shell material or their shell thickness can take place while taking the required strength into account. Hardened metallic hollow bodies can thus also be used, for example.

The piece of sports equipment in accordance with the invention can be designed and also used as baseball bats, tennis rackets, golf clubs, ski poles, skis, skateboards or snowboards.

Vibrations which occur as a result of an impact of a ball or of a blow onto the piece of sports equipment can be damped better and in a much shorter time using the invention than is the case in the prior art. In this respect, in particular the solid particles included in the hollow bodies or the further hollow bodies have a favorable effect for the vibration damping. In addition, a plurality of hollow bodies should directly contact one another. Vibrations can be transmitted from hollow body to hollow body by the mutually contacting shells.

The invention will be explained in more detail in the following with reference to examples.

Figure 2:
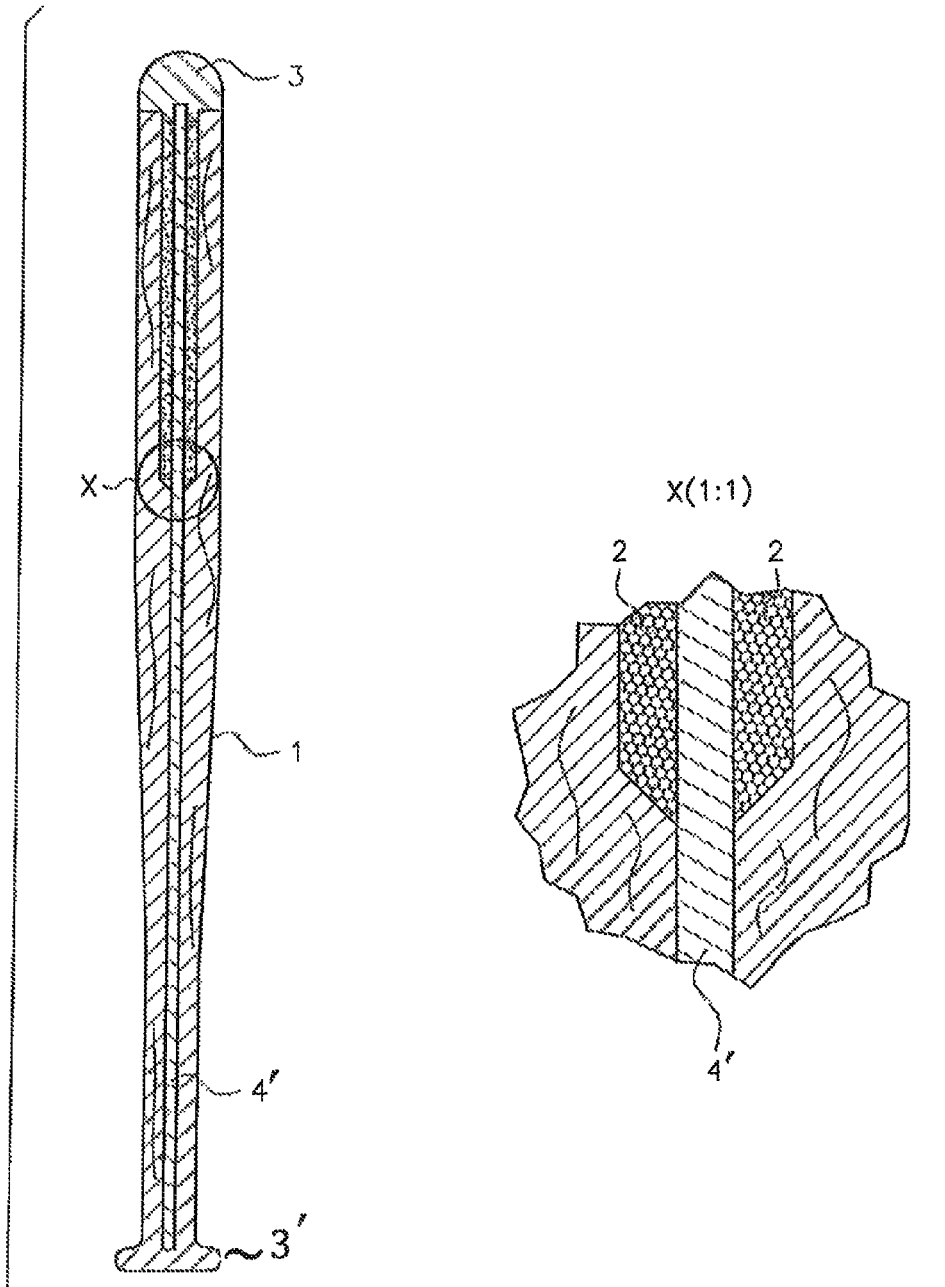
Figure 3:
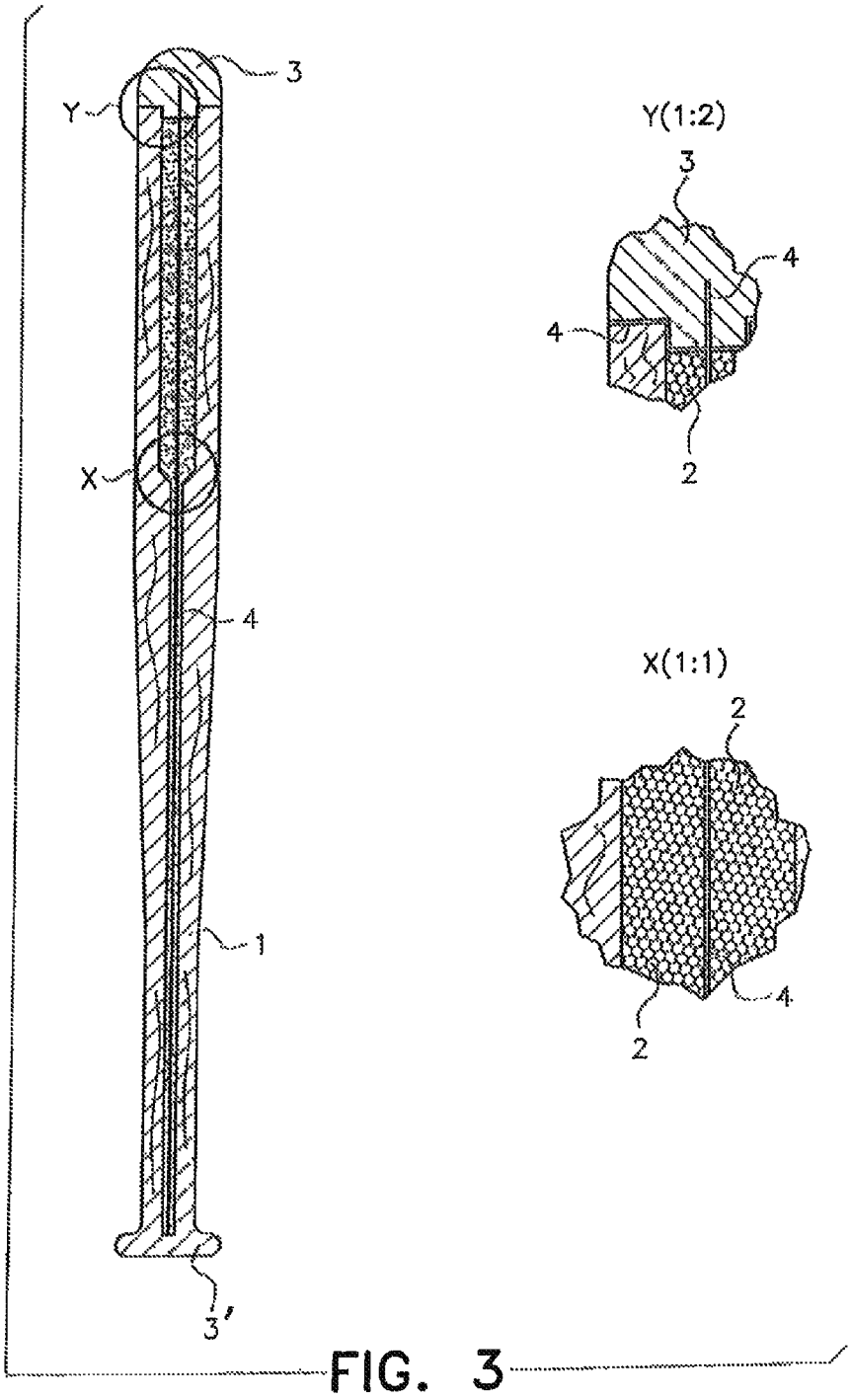
Figure 4A:
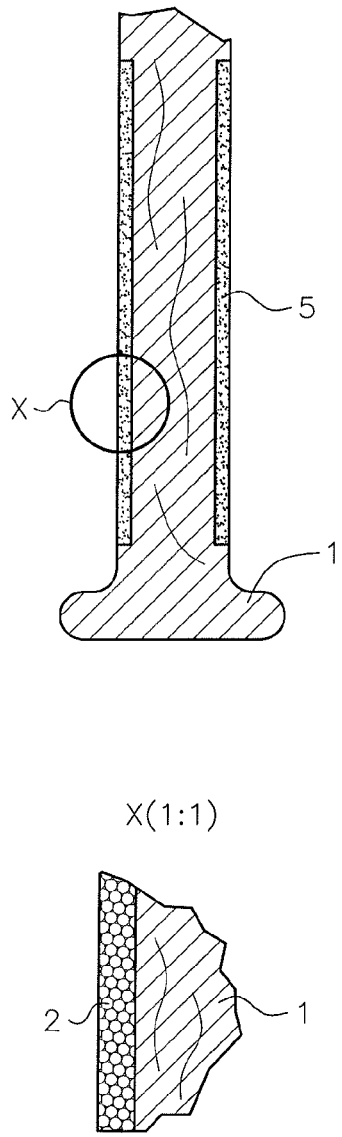
Figure 4B:
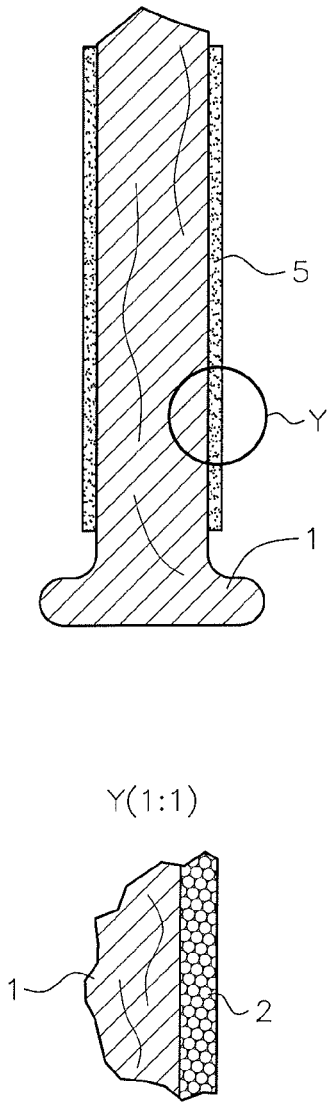

There are shown:

FIG. 1 a schematic sectional representation through a baseball bat as an example for a piece of sports equipment in accordance with the invention;

FIG. 2 another embodiment of a baseball bat as a further example of a piece of sports equipment in accordance with the invention in a sectional representation;

FIG. 3 another embodiment of a baseball bat as a further example of a piece of sports equipment in accordance with the invention in a sectional representation; and FIGS. 4A and 4B examples with handle regions present at the piece of sports equipment.

The following procedure can be followed in the manufacture of hollow bodies:

EXAMPLE 1

3 liters of spherical cores of prefoamed expandable polystyrene (EPS) whose mean diameter amounts to 5.7 mm were coated with a first layer. This coating comprises 70% by volume aluminum oxide powder with a particle size in the range from 2 to 40 μm and 30% by volume zinc stearate powder in an aqueous PVA (polyvinyl alcohol) binder solution. A total of 870 g of aluminum oxide powder was applied. Subsequent to the formation of this first layer directly on the surface of the cores, a further layer was applied which is formed from an aqueous PVA (polyvinyl alcohol) binder solution as well as carbonyl iron powder having a mean particle size of 6 μm. In this respect, a total of 430 g carbonyl iron powder was applied to the cores already coated with aluminum oxide powder.

Subsequently, a heat treatment took place to expel the organic components and to form an outer closed shell of hollow bodies by sintering in an inert gas atmosphere at a maximum temperature of 1120° C.

Subsequent to the heat treatment, hollow bodies of iron were obtained in which freely movable, loose, solid particles of aluminum oxide were enclosed. The bulk density of the filled spheres amounted to 0.44 g/cm$^3$ and the degree of filling of the sintered hollow balls with aluminum oxide in this respect amounted to around 20 to 25% with a mean sphere diameter of 5.4 mm.

EXAMPLE 2

2 liters of prefoamed polystyrene cores having a diameter of 2.9 mm were coated with a mixture comprising 75% by volume magnesium oxide powder with a particle size in the range from 1 to 15 μm and 30% by volume of polyethylene glycol with a melting temperature above 80° C. in an aqueous binder solution. A total of 280 g magnesium oxide powder was applied.

A separating layer of polyethylene glycol having a melting temperature above 80° C., which is kept free of particles, is applied with a thickness of around 80 μm on this layer applied directly to the cores.

An outer layer suitable for the forming of a shell of the hollow bodies was in turn applied to this separating layer. 680 g carbonyl iron in an aqueous PVA suspension were applied to the cores already coated with magnesium oxide.

After the formation of this coating comprising three individual layers, a heat treatment in turn took place to expel the organic components and to sinter the outer shell of alloyed iron in an inert gas atmosphere at a temperature of a maximum of 1250° C.

The hollow bodies manufactured in this manner then formed hollow spheres including magnesium oxide particles in loose, freely movable form. The mean diameter of the sintered hollow spheres amounted to 2.8 mm with a bulk density of 0.5 g/cm$^3$. The degree of filling of the hollow spheres with magnesium oxide amounted to around 20 to 25% of the inner volume.

An example of a baseball bat is shown in FIG. 1. In this respect, the support element 1 of wood has been provided with an inner hollow space. The hollow space is filled with a mixture of metallic hollow spheres 2 which are filled in their interior with solid particles having a total mass portion of 20% with respect to the total mass of the hollow spheres 2. The hollow spheres 2 have an outer diameter in the range of 2 mm to 3 mm and comprise iron in this example. The hollow spheres 2 are in this example embedded in a matrix of epoxy resin which connects the base body formed from the epoxy resins with the hollow spheres to the support element 1 with material continuity. The support element has a wall thickness of 15 mm in the region of the hollow space in which the base body is received. An opening for filling is provided at the upper side at the support element 1 and is closed by a closure element 1' after filling. The baseball bat has a length of 1066 mm and has an outer diameter of 69.8 mm at the distal end disposed opposite the grip region. In FIG. 1, a detail X is moreover shown from which the arrangement of the hollow spheres 2 as hollow bodies can be seen.

The baseball bat shown in FIG. 2 differs from the example in accordance with FIG. 1 essentially in that the hollow space is closed by an anchor element 3 at the proximal end and at the distal end of the support element 1 and the hollow space is led from the proximal end to the distal end of the support element 1. In addition, a core element 4' of metal is arranged in the hollow space and is conducted from one anchor element 3 to the other anchor element 3'. The safety on a break of the support element 1 which can occur can be increased by the core element 4' and a release of parts can be prevented in so doing. In addition, the total mass of the baseball bat can be influenced by the mass of the core element. The mass distribution over the length of the baseball bat can also be influenced by a variation of the outer diameter of the core element 4', which is not shown in FIG. 2. The core element 4' has a thickness of 10 mm over the total length in this example.

It becomes clear from the detail X shown in FIG. 2 that hollow spheres 2, as hollow bodies, surround the core element 4', with this only being the case in a region of the hollow space which is arranged subsequent to the distal end of the baseball bat. This region has a length of 320 mm here.

The baseball bat shown in FIG. 3 differs from the example in accordance with FIG. 1 essentially in that the hollow space is closed by an anchor element 3, 3' at the proximal end and at the distal end of the support element 1 and the hollow space is led from the proximal end to the distal end of the support element 1. In addition, a band 4 of carbon fiber reinforced plastic engages at both anchor elements 3, 3' and is tensioned. The safety on a break of the support element 1 which can occur can be increased by the band 4 and a release of parts can be prevented in so doing. The detail X shows how the band 4 is guided through the hollow space and is surrounded by hollow spheres 2. Hollow spheres 2 are also only present in a region of the hollow space here, as in the example of FIG. 2.

The detail Y shows a fixing possibility of the band 4 at the distal anchor element 3.

In the examples in accordance with FIGS. 2 and 3, hollow spheres 2 were used, as in the example of FIG. 1.

Examples with grip regions 5 present at the piece of sports equipment are shown in FIGS. 4A and 4B. In this respect, the grip region 5 is formed with a receiver in the example of FIG. 4A. The support element 1 is reduced in outer diameter in the grip region 5 so that a corresponding groove-like incision is present there. In the region thus tapered, hollow spheres 2 area arranged as hollow bodies and they are connected to one another and to the support element 1.

In the example shown in FIG. 4B, the hollow spheres 2 are arranged directly on the surface of the support element 1 in the grip region 5 and are fastened accordingly. A suitable binder or adhesive can be used for the fastening.

The detail representations X and Y illustrate the arrangement and fixing of the hollow spheres 2 at the support element 1 and among one another.

The invention claimed is:

1. A piece of sports equipment comprising an elongated support element (1) including at least one hollow region inside the support element and in which metallic and/or ceramic hollow bodies (2) are provided within said at least one hollow region wherein said at least one hollow region is closed by at least one anchor element (3) at a proximal end or at a distal end of said support element and wherein said at least one anchor element (3) is fastened to the support element (1) by a core element (4'), a pulling cable or a band (4) extending through the hollow space from at least one anchor element to a fastening point or to a second anchor element (3'), the core element (4'), pulling cable or band (4) provided with a means to exert a tension or pulling force on said one anchor element (3) toward said fastening point or second anchor element (3').

2. A piece of sports equipment in accordance with claim 1, characterized in that freely movable solid particles are in the hollow bodies (2).

3. A piece of sports equipment in accordance with claim 1, characterized in that the hollow bodies (2) are hollow spheres.

4. A piece of sports equipment in accordance with claim 1, characterized in that hollow bodies are connected to one another with material continuity and/or are embedded in a matrix of a substance.

5. A piece of sports equipment in accordance with claim 1, characterized in that the hollow bodies (2) are filled to at least 5% of their inner volume with solid particles.

6. A piece of sports equipment in accordance with claim 1, characterized in that openings at a distal end and at a proximal end of the support element (1) are closed by a respective anchor element and a hollow region extends through the total support element (1) from the distal opening to the proximal opening.

7. A piece of sports equipment in accordance with claim 1, characterized in that the support element (1) is formed from wood, metal, in particular aluminum or an aluminum alloy, or from a composite material.

8. A piece of sports equipment in accordance with claim 1, characterized in that hollow bodies (2) having different outer diameters, shell thicknesses and/or portions of solid particles included therein are used.

9. A piece of sports equipment in accordance with claim 1, characterized in that the outer skin of the hollow bodies (2) comprises a sintered metal and/or a sintered ceramic material.

10. A piece of sports equipment in accordance with claim 1, characterized in that hollow bodies (2) having an additional substance in the interior of the support element (1) are connected to the support element (1) with material continuity.

11. A piece of sports equipment in accordance with claim 1, characterized in that a reinforcement component is additionally included with the hollow bodies (2) in the interior of the support element (1), in particular in the form of a fiber mat, individual fibers or fiber bars.

12. A piece of sports equipment in accordance with claim 1, characterized in that a grip region (5) of the piece of sports equipment is formed with mutually sintered hollow bodies (2), wherein the hollow bodies (2) in the grip region (5) are arranged on the surface of the support element (1) and are applied there and/or are arranged in a receiver formed at the surface of the support element (4) and are fastened to the support element (1) there.

13. A piece of sports equipment in accordance with claim 1, wherein the piece of sports equipment is used as a baseball bat, a tennis racket, a golf club, a ski pole, a ski, a skateboard or a snowboard.

* * * * *